US005168690A

United States Patent [19]

Quadrana

[11] Patent Number: 5,168,690

[45] Date of Patent: Dec. 8, 1992

[54] CIGARETTE-PACKING MACHINE, SPECIFICALLY FOR PACKING CIGARETTES INTO HARD BOXES WITH AN INTEGRAL HINGED LID

[75] Inventor: Marcelo Quadrana, Lomas de Zamora, Argentina

[73] Assignee: SASIB S.p.A., Bologna, Italy

[21] Appl. No.: 772,419

[22] Filed: Oct. 7, 1991

[30] Foreign Application Priority Data

Oct. 18, 1990 [IT] Italy ..... 12525 A/90

[51] Int. Cl.[5] ..... B65B 19/24

[52] U.S. Cl. ..... 53/575; 53/234; 493/911

[58] Field of Search ..... 53/575, 574, 234, 232, 53/231, 230; 493/94, 910, 911

[56] References Cited

U.S. PATENT DOCUMENTS

| | | | |
|---|---|---|---|
| 2,512,922 | 6/1950 | Dearsley | 493/910 X |
| 3,802,325 | 4/1974 | Bardenhagen et al. | 53/575 X |
| 4,144,695 | 3/1979 | Seragnoli | 53/234 |
| 4,330,976 | 5/1982 | Blackall et al. | 53/575 X |
| 4,596,112 | 6/1986 | Buckley et al. | 53/234 X |

*Primary Examiner*—James F. Coan

*Attorney, Agent, or Firm*—Larson and Taylor

[57] ABSTRACT

A cigarette-packing machine for packing cigarettes into hinged-lid hard boxes. The machine is fitted with an arbor-carrying drum (1) which is stepwise rotatable around its axis, and has a plurality of tubular matrices or arbors (3) projectingly mounted thereon. Hard cigarette boxes (P) are formed by blanks (F) and neck elements (C) to be folded about arbors (3) in a number of operative steps carried out at successive cigarette box-forming stations (S1 and S12), arranged around the arbor-carrying drum (1). In order to have the neck elements (C) accurately laid on the respective arbor (3), in their correct position relative to a box (P), the machine provides for the neck elements (C) and the blanks (F) to be separately fed. A device (14, 15) is provided in station (S3) for the neck elements (C) to be fed transversally to the longitudinally axis of arbors (3) and to be folded, and a device (23) is provided in a successive station (S4) for the blanks (F) to be fed parallelly to the longitudinal axis of arbors (3).

28 Claims, 11 Drawing Sheets

28
S4
F5
5
4
23
24
F15
F8
26
F3
F11
F9
125
F10
25
F16
F7
F2
F6
F1
F14
127
F12
F4
F17
F13
327
227
L
C'
R
3
101
F
S4
F17

CIGARETTE-PACKING MACHINE, SPECIFICALLY FOR PACKING CIGARETTES INTO HARD BOXES WITH AN INTEGRAL HINGED LID

SUMMARY OF THE INVENTION

This invention relates to a cigarette-packing machine, specifically for packing cigarettes into hard boxes with an integral hinged lid, in which a hard box is formed by causing a suitable cigarette box blank and a separate neck element to be folded about an associated tubular matrix or arbor, that is open at both of its end sides and is fit for receiving thereinto an orderly group of cigarettes, a rotatable arbor-carrying drum being provided, with a plurality of arbors being projectingly fitted thereon in an angularly equispaced relation, and being angularly moved by the stepwise rotated arbor-carrying drum the one after the other into successive cigarette box-forming stations, stationary folding means and movable folding means being provided at the several stations, for cooperation with the respective arbors.

In the present specification and in the claims, by the term "neck element" a small blank is meant, which is made of cardboard, paperboard, or the like, and is to be fitted in a cigarette box to form the upper edge portion thereof, the reclosable hinged lid of a cigarette box being superposed to the said neck element with the lid in closed condition.

Cigarette-packing machines of this type are actually known. In these known machines only one type of blank involving a considerable waste of material, is used for making a cigarette box. Moreover, the feeding of neck elements and blanks is effected by simultaneously feeding the same to the respective arbor in the arbor-carrying drum. A neck element is then previously fastened in the correct position to the respective cigarette box blank. The fastening of a neck element to the respective blank is effected by means of glue. However, owing to the short path along which a neck element/cigarette box blank assembly is fed to an arbor, the glue has not yet set at the time this assembly has reached the associated arbor. Therefore, such a fastening of a neck element to a blank does not guarantee that the neck element be firmly positioned relative to the respective blank, particularly during the folding operations of the neck element/cigarette box blank assembly about the associated arbor. It ensues that a reciprocal displacement of the said two assembled parts may take place, which may cause a cigarette box to be badly shaped, and may even produce a detrimental jamming of the cigarette-packing machine.

The invention is grounded on the problem of providing a cigarette-packing machine of the type as stated at the outset, in which the aforementioned drawbacks of the known cigarette-packing machines are eliminated, particularly by using means being relatively simple in construction, and therefore not much expensive.

The invention solves this problem by the provision of a cigarette-packing machine of the type as stated at the outset, wherein means are provided at a cigarette box-forming station for feeding a neck element to an arbor, by which a neck element is fed to the respective arbor transversally to the longitudinal axis thereof, means for feeding cigarette box blanks being provided at a successive station.

The neck element-feeding means are preferably so provided that a neck element will be placed in contact with the fore side of the respective arbor-by taking into account the forward direction of the arbor's angular movement, and will be arranged exactly in the position that a neck element must take relative to a cigarette box blank.

The cigarette-packing machine is advantageously fitted with means for retaining a neck element in position on the respective arbor, and with means for folding the neck element over the arbor end sides which are arranged transversally to the radial direction of the arbor-carrying drum, and with means for holding the neck element in such a folded position against the associated arbor, while a cigarette box blank is being fed to the successive cigarette box-forming station.

According to a further feature of this invention, the cigarette-packing machine is fitted with suitable means for ensuring that a blank be exactly positioned relative to the associated arbor, which specifically are in form of blank-positioning abutment members.

Also other features further improving the cigarette-packing machine form the object of the invention, and are the subject of the dependent Claims.

The particular features of the invention and the advantages arising therefrom, will appear more in detail in the following specification of one preferred embodiment thereof, which is shown by way of a non-limiting example in the accompanying drawings.

BRIEF DESCRIPTION OF THE DRAWINGS

FIG. 28 shows a modified embodiment of the pusher member for insertion of the formed cigarette boxes into the cigarette box removal channel.

DESCRIPTION OF THE PREFERRED EMBODIMENTS

Figure 1:
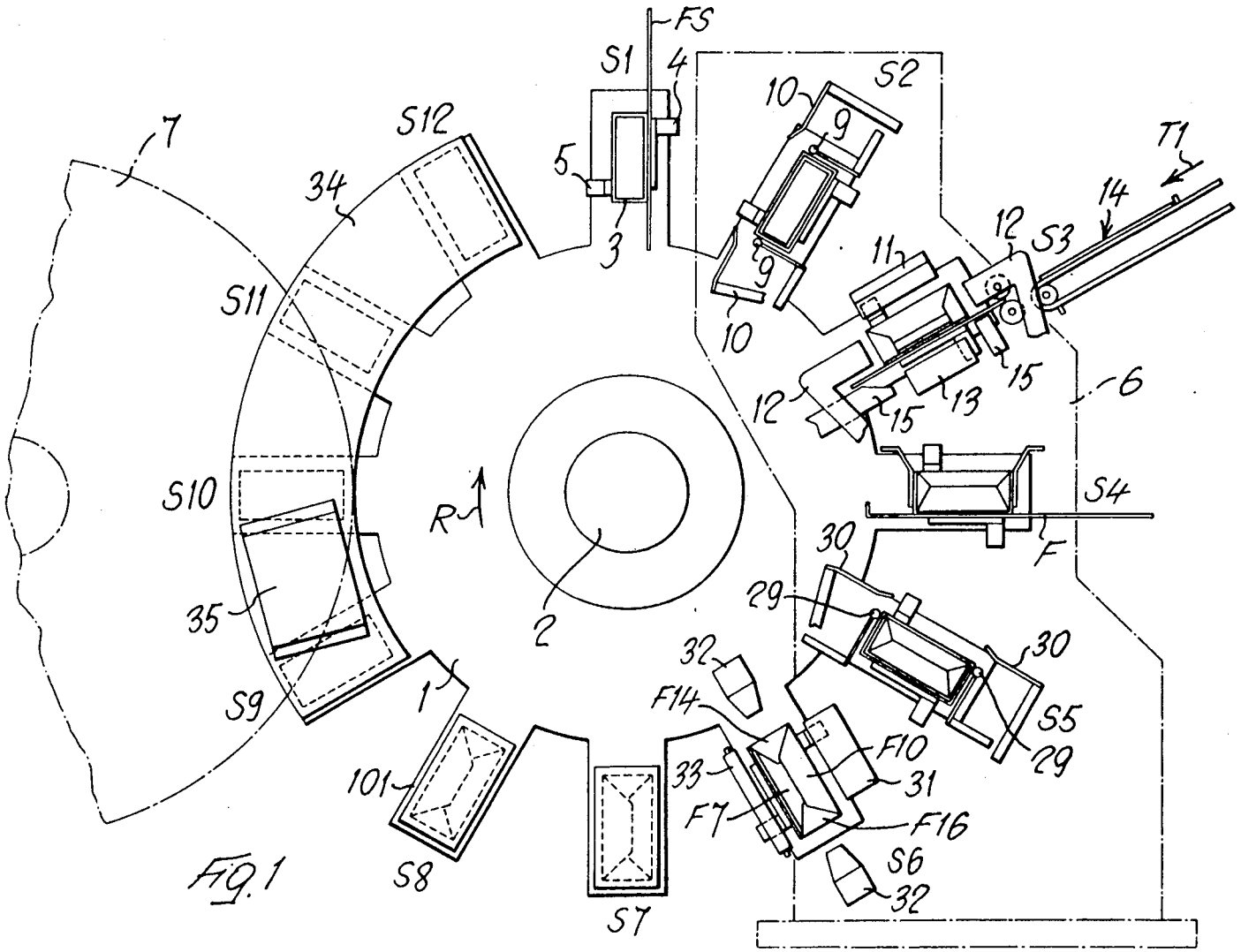
FIG. 1 is a diagrammatic front view of the arborcarrying drum in the cigarette-packing machine according to the invention, in which also the neck element-feeding device is shown.
Figures 2, 2B:
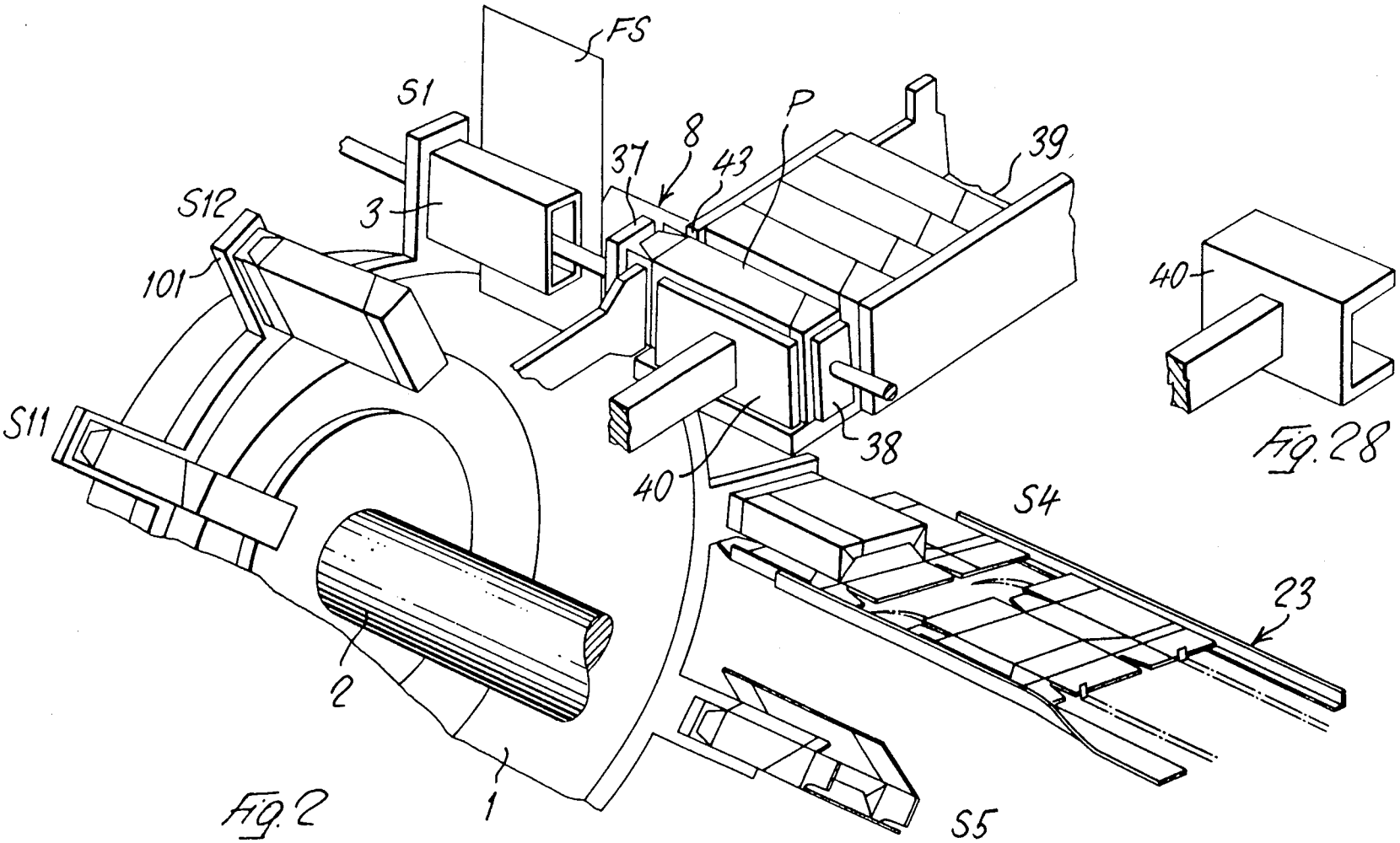
FIG. 2 is a perspective view showing that part of the arbor-carrying drum to which are associated a device for feeding blanks to be made into hard boxes for cigarettes, and a device for discharging the finished cigarette boxes.
Figure 3:
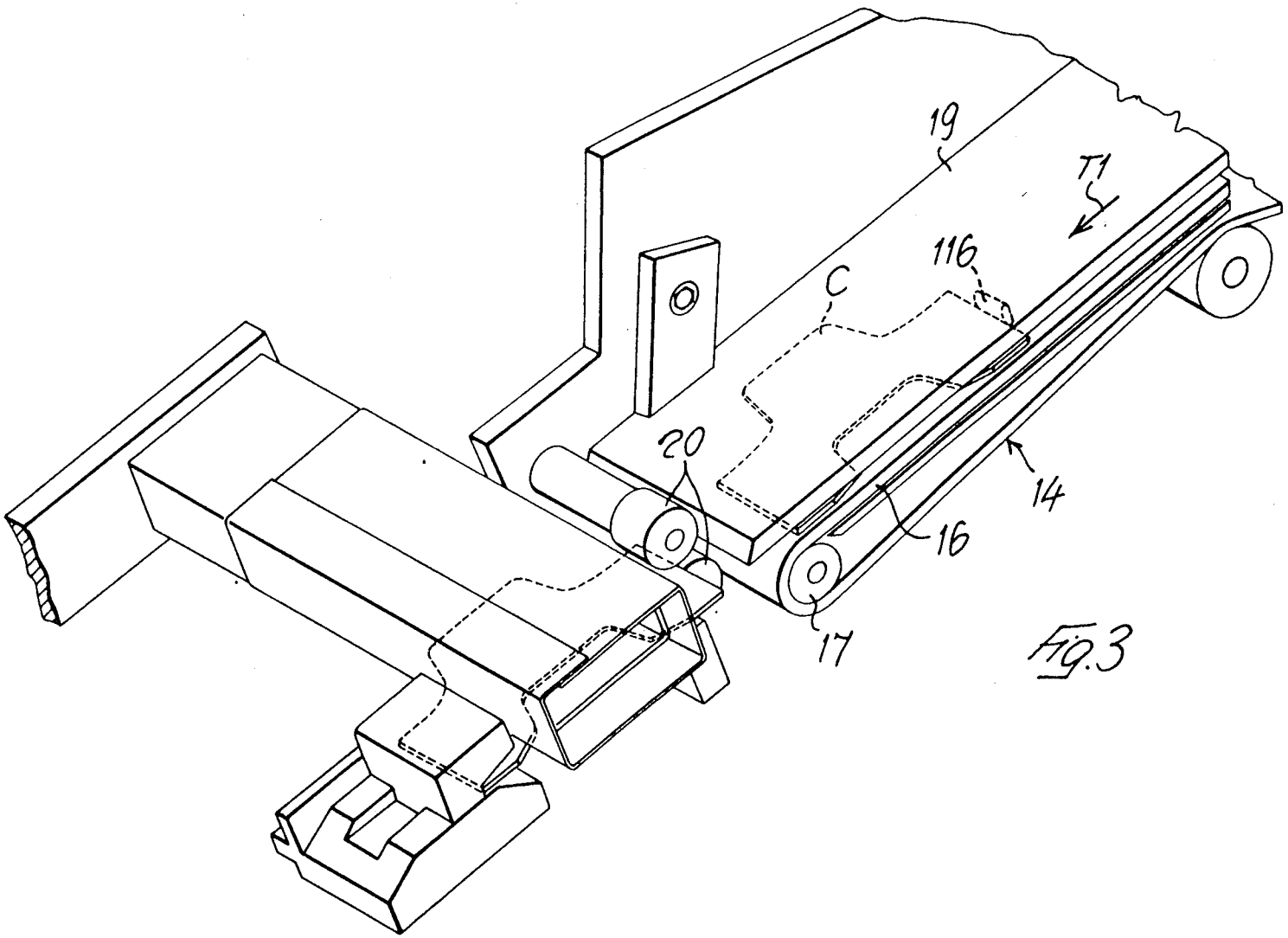
FIG. 3 is a perspective view showing the neck element-feeding device, and an associated arbor.
Figures 4, 5:
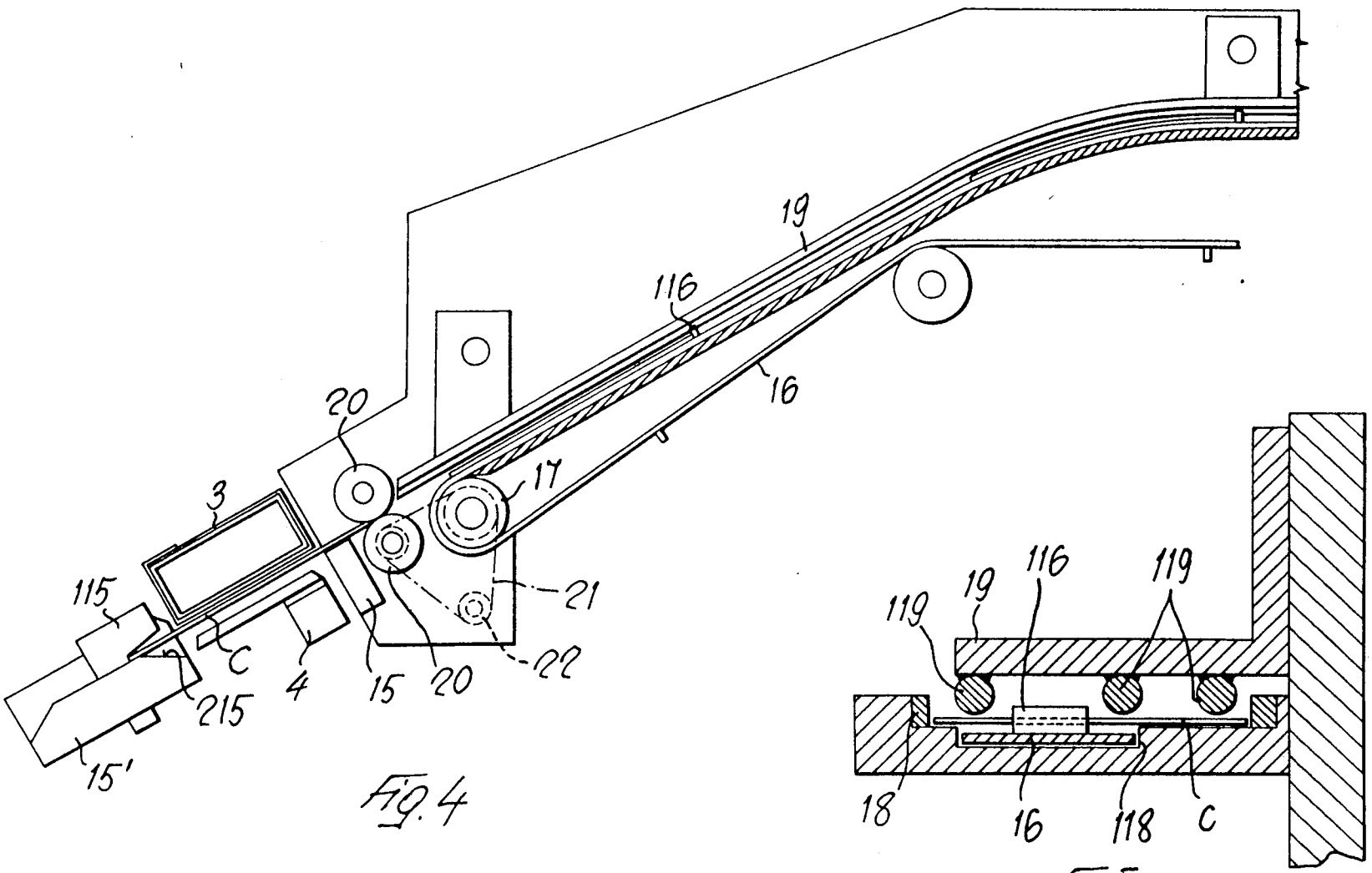
FIG. 4 is an axial sectional view taken through the neck element-feeding device shown in FIG. 3.
FIG. 5 is a cross-sectional view taken through the neck element-feeding device according to FIGS. 3 and 4.

Referring to FIGS. 1 and 2, the cigarette-packing machine according to the present embodiment of the invention, comprises a drum 1 which is mounted on shaft 2 (arrow R) so as to be rotatable around its axis. The drum 1 is fitted with twelwe radially extending spoke members 101, with a tubular matrix or arbor 3 being projectingly mounted onto each one of them. Each arbor 3 is open at both of its end sides and has its longitudinal axis arranged parallel to the axis of rotation of the arbor-carrying drum 1. Hard boxes for cigarettes are each formed by means of a suitable cigaretteenclosing tin foil sheet and cigarette box blank to be folded about the associated arbor, an orderly group of cigarettes being fed into each box subsequently to the cigarette box folding steps. Associated with each arbor 3 are a tin foil sheet-retaining pressure member 4 and a tin foil sheet edge-holding pressure member 5, which are caused to cooperate respectively with that side of an arbor 3 which is arranged in the forward direction of the arbor's angular movement, and with the arbor's opposite side. The pressure members 4 and 5 are both carried by the arbor-carrying drum 1, so that the same are caused to follow the relative arbor 3.

Associated with the arbor-carrying drum 1 are driving means for the arbor-carrying drum 1 to be stepwise rotated each time by 30° in the direction of arrow R in FIG. 1, such a stepwise rotation of the arbor-carrying drum being alternated with dwelling times. Around the arbor-carrying drum 1 a plurality of operative stations S1-S12 are provided in matching relation with the 30° steps of the arbor-carrying drum rotation, so that by the arbor-carrying drum being each time rotated by one step, each arbor 3 is angularly moved into a successive operative station, in which determinate cigarette box-forming operations are performed.

In the initial part of an arbor travel from station S1 to station S6, a turret 6 is associated with the arbor-carrying drum 1, and holds at locations close to the stations S1 to S6, the respective folding means and/or feeding devices, and the means for synchronously driving and controlling the same. In the successive final part of an arbor travel, various means may be associated with the arbor-carrying drum 1, such as means for impressing any dry markings on a cigarette box, means for heating a cigarette box so as to promote a quicker setting of the glue, and a drum 7 for feeding orderly groups of cigarettes into arbors 3. The said drum 7 is provided with driving means that are suitably synchronized with the arbor-carrying drum 1.

At the station for delivery of a finished cigarette box and for feeding of a tin foil sheet FS, which is designated by reference S1 in the Figures, means for closing the bottom end side of a cigarette box, means 8 for ejection of a finished cigarette box, and a device for feeding tin foil sheets FS are associated with the arbor-carrying drum 1, the tin foil sheet-feeding device being known per se, so that it is not shown in detail.

Figure 7:
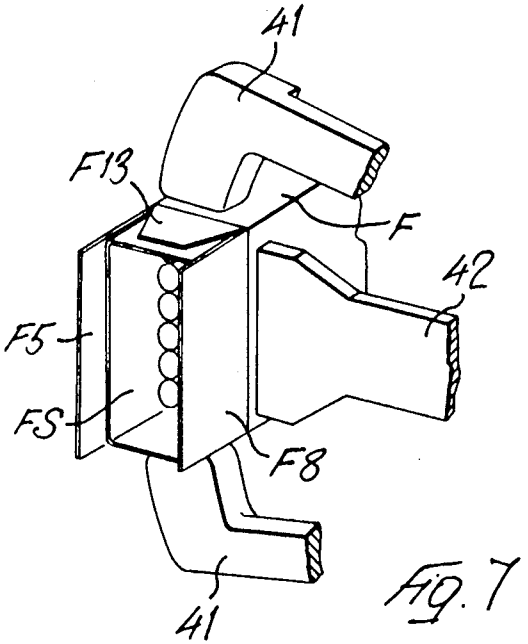

Referring to FIG. 2, the means 8 for ejection of a finished cigarette box P from the associated arbor 3 is in form of a pusher member 37 by which an orderly group of cigarettes is slipped out of its arbor 3 simultaneously with the relative box P, still in open condition at its bottom end side. Associated with the pusher member 37 is an oppositely arranged pusher member 38 acting in the contrary direction. The pusher member 38 is for limiting the ejection travel of the formed cigarette box P, whereby the same is stopped in a position coinciding with a cigarette box removal channel 39. The cigarette box removal channel 39 has its longitudinal axis arranged transversally to the longitudinal axis of an arbor 3. A pusher member 40 is provided at a location coinciding with the said removal channel 39, for co-operation with the side of box P lying opposite to the inlet of said channel. By the pusher member 40 the finished cigarette box P is inserted into the cigarette box removal channel 39, in an abutting relation with the other cigarette boxes in this channel, which are thus moved forward one at a time. The pusher member 40 has not a flat configuration as diagrammatically shown in FIG. 2, but is preferably C-shaped in cross-section, as shown in FIG. 28. This in order to prevent that a cigarette box P may be deformed while being inserted into the cigarette box removal channel 39. Means for closing the bottom end side of the cigarette box P before being caused to get into the cigarette box removal channel 39, are provided at the associated side of the inlet of said channel 39. The said means are in form of movable folding means 41, 42 which are provided respectively for the connection flaps F13 and F15 (see also FIG. 7) and the flap F8 of a blank F to be folded at the same time as the associated parts of the cigarette-enclosing tin foil sheet FS, over the bottom end side of a cigarette box P.

The movable, that is pivotable, folding means 41 for folding the connection flaps F13 and F15 and the associated flaps of the cigarette-enclosing tin foil sheet FS, are in form of a pair of hammer-like members being angularly movable the one against the other along the plane which is substantially tangential to the bottom end side of the cigarette box P. The movable folding means 42 for folding the flap F8 is in form of a suitably sized blade. The flap F5 of blank F, which is associated with the front side of the cigarette box P, i.e., with the fore side of the respective arbor 3—by taking into account the direction of rotation of the arbor-carrying drum 1, is folded by the stationary folding means 43 over the cigarette box bottom end side, and is superposed to the flap F8. The stationary folding means 43 is advantageously formed by the end side edge of the adjacent vertical wall of the cigarette box removal channel 39, the inner side of said wall being substantially tangential to the bottom end side of a cigarette box P, whereby the said flap F5 is folded as a cigarette box P is being inserted into the cigarette box removal channel 39.

Figure 8:
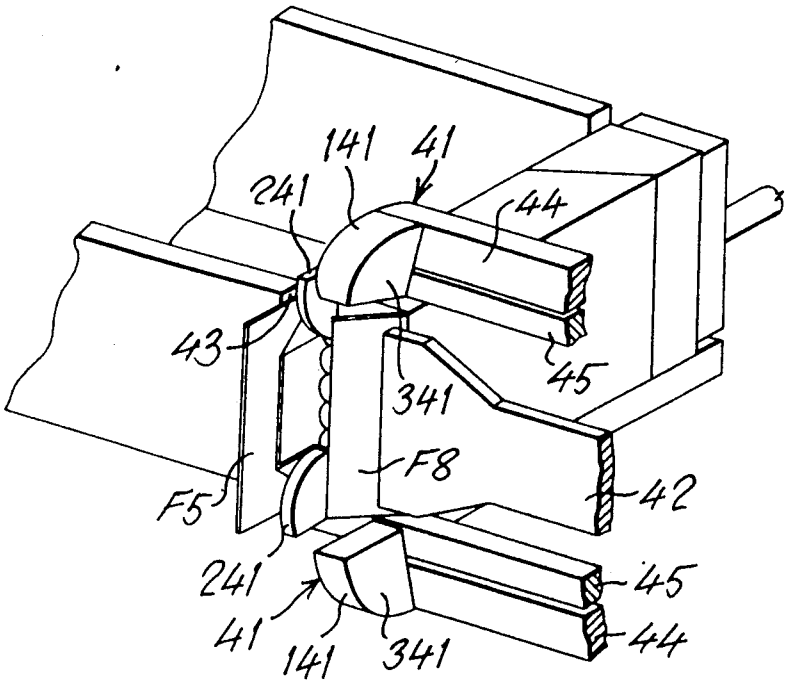
FIGS. 7 and 8 are perspective views showing a modified embodiment of the means for folding the bottom end side of a cigarette box.

According to a modified preferred embodiment of the invention, in order to prevent any upward movement of the connection flaps F13, F15 after the above-disclosed hammer-like folding members 41 having been returned into rest position, which may adversely affect the operation of the folding blade 42, the pivotable folding means for folding the connection flaps F13, F15, are not in form of hammer-like members, as disclosed above, but consist of folding heads 141 which are associated with a respective retaining head 241. As shown in FIG. 8, the retaining head 241 and the folding head 141 in each folding means 41 are fitted on a respective arm 44, 45 which is angularly movable around its longitudinal axis, and causes the folding heads 141 and the retaining heads 241 to be pivoted against the cigarette box bottom end side. The retaining head 241 and the folding head 141 in each folding means 41 are arranged in a side-by-side relation. The folding heads 141 are thicker than the retaining heads 241, and are each interposed between the respective retaining head 241 and the folding blade 42. To cause the connection flaps F13 and F15 to be folded, the folding heads 141 and the retaining heads 241 are at the same time angularly moved against the bottom end side of a cigarette box P. The folding heads are immediately returned into rest position, while the retaining heads are kept in their folded flap-retaining position, so that any upward movement of the connection flaps F13, F15 is prevented before the folding blade 42 having been caused to start its folding stroke for folding the flap F8, during which the folding blade running over the flap F8, causes the flap F8 to be superposed to the said connection flaps F13, F15. The retaining heads 241 are then returned into rest position earlier than the folding blade 42 may interfere with the said heads in the final part of its stroke. The folding heads 141 may advantageously have a substantially wedge-shaped configuration, with their side 341 turned toward the folding blade 42 being given such an inclination that substantially corresponds to a certain inclination of flap F8 at the beginning of its folding step.

At the successive station S2 for a tin foil sheet FS to be folded about the respective arbor 3, the turret 6 holds stationary folding means 9 and movable, that is pivotable, folding means 10. The stationary folding means are in form of rollers which are arranged at such a distance between them that corresponds to the extent in the radial direction of an arbor 3, and are caused to cooperate with the arbor end sides extending transversally to the arbor's radial direction. The pivotable folding means 10 are caused to cooperate with the rear side of an arbor 3, by taking into account the direction of rotation (arrow R) of the arbor-carrying drum 1.

Figure 16:
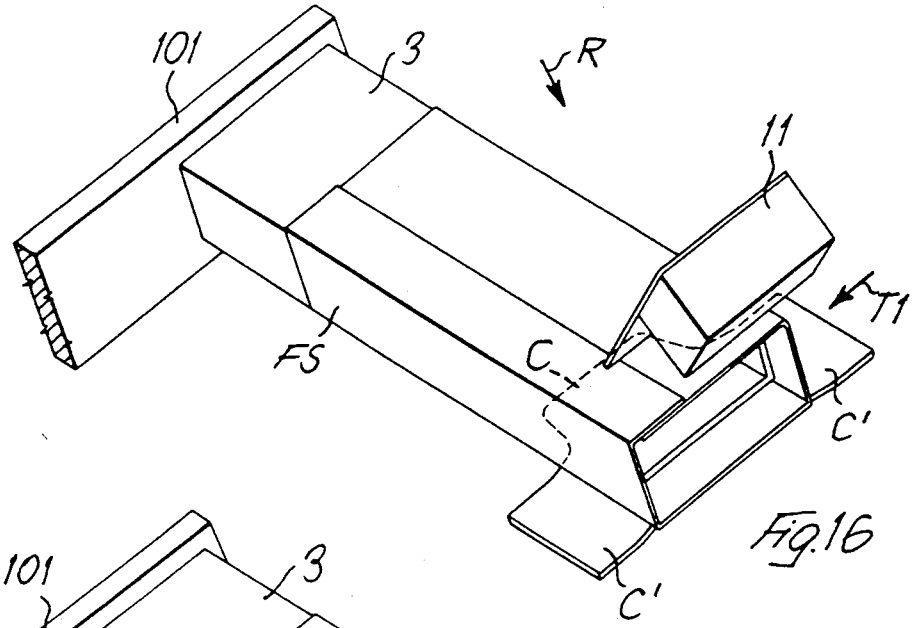
FIGS. 16 to 18 show the steps of folding a tin foil sheet over a cigarette box top end side, and the neck element folding steps.
Figure 17:
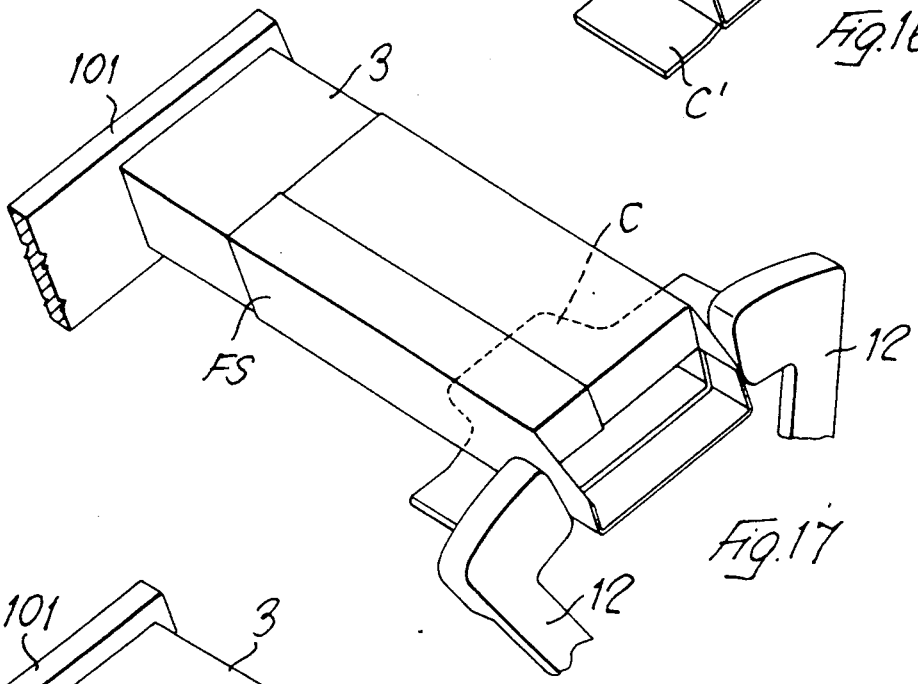
Figure 18:
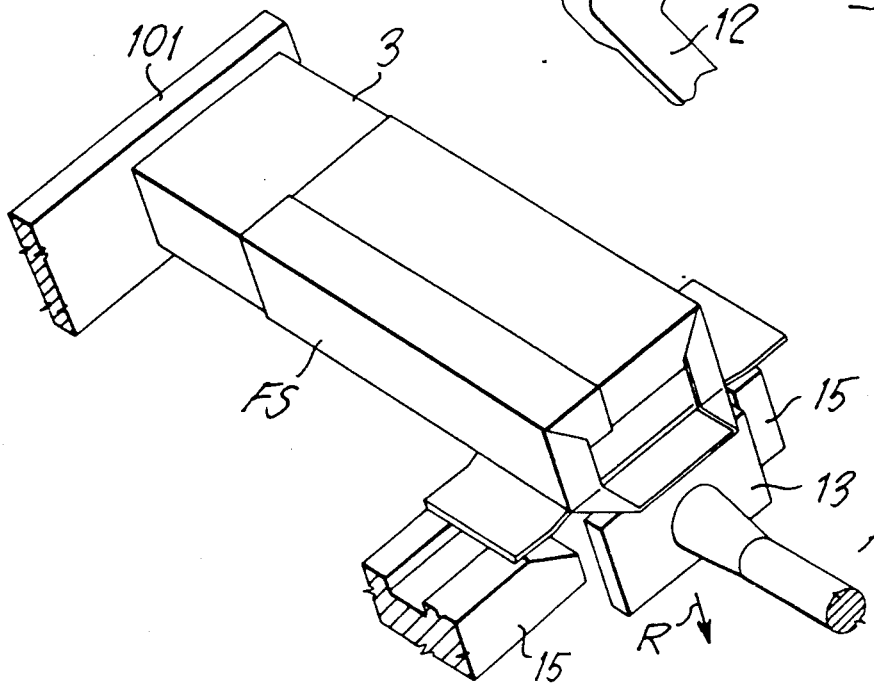

At the successive station S3 for a tin foil sheet FS to be folded over the free end side of the associated arbor 3, and for a neck element C to be fed thereto, pivotable folding means 11, 12 and stationary folding means 13 are provided for folding the flaps of the tin foil sheet FS which project from the free end side of the respective arbor 3, and feeding means 14 and stationary folding means 15, 15' are also provided, respectively for feeding a neck element C and for folding the neck element C. More particularly, as shown in FIGS. 16 to 18, the folding means for folding the projecting flaps of a tin foil sheet FS consist of the following means: a pivotable folding means 11 which is associated with the rear side of the respective arbor 3, and is for folding the flap projecting therefrom of a tin foil sheet FS, the said folding means 11—whose length substantially corresponds to the radial extent of an arbor 3, being angularly movable against the free end side of the respective arbor 3; two hammer-like pivotable folding means 12 for folding the projecting tin foil sheet flaps which extend transversally to the radial direction, the said hammer-like folding means 12 being angularly movable against each other, in a plane which is tangential to the free end side of the respective arbor 3; a folding means 13 in form of a stationary abutment member, which is associated with the fore side of arbor 3—by taking into account the forward direction of the arbor's angular movement (arrow B), and is for folding the flap of a tin foil sheet FS, projecting from the arbor fore side.

According to a particular feature of the invention, and as shown in FIGS. 1, 3, 4, and 5, the feeding means 14 for feeding neck elements C to arbors 3 is in form of a preferably continuous belt conveyor 16 lead over motor-driven guide rollers 17. The belt conveyor 16 is accomodated and guided in a channel 118 formed in the bottom of a channel-shaped guide 18 for neck elements C to be fed to the respective arbor 3, and is fitted with neck element-entraining teeth 116 projecting upwardly from the belt conveyor 16, and being set at an equal distance between them that corresponds to the length dimension of neck elements C. The neck element-entraining teeth 116 are caused to cooperate respectively with the rear end side edge of a neck element C, by taking into account the neck element conveyance direction T1. The guide 18 for feeding neck elements C is straight, and is inclined at its end section associated with an arbor 3, with its conveyance plane extending radially to the arbor-carrying drum 1. The neck elements C are received in the neck element-feeding guide 18, with their longitudinal axis being arranged in the neck element conveyance direction, and the width of this guide is such that any transversal movement of neck elements C is prevented. In an overlying relation with the neck element-feeding guide 18, a retaining means 19 is provided for preventing the neck elements C from raising from guide 18. The retaining means 19 is in form of a plate fitted with neck element-retaining members 119 which project from the plate face turned toward the guide 18, and which specifically consist of a plurality of rod members arranged in the neck element conveyance direction T1. The longitudinal axis of guide 18 for feeding neck elements C, and so the longitudinal axis of belt conveyor 16, are arranged in the radial direction of the arbor-carrying drum 1, i.e., transversally to the longitudinal axis of the respective arbor 3. Neck elements C are thus fed to a respective arbor 3 with their longitudinal axis extending transversally to the arbor's longitudinal axis. Downstream of guide rollers 17 two counter-rotating speed-up rollers 20 are provided at the delivery end of belt conveyor 16, and the plane at which the said speed-up rollers are tangent, is coplanar to the conveyance plane of the neck element-feeding guide 18, the said planes substantially lying slightly before the fore side of an arbor 3—by taking into account the forward direction of the arbor's angular movement. The counter-rotating speed-up rollers 20 are preferably driven by their own motors. As an alternative, the counter-rotating speed-up rollers 20 may be driven together with the guide rollers 17 by a suitable drive, such as a belt drive 21, and by means of a pulley or a motor-driven shaft 22. Immediately downstream of the counter-rotating speed-up rollers 20 a neck-element-folding stationary means in form of a block-shaped abutment member 15, is provided between the said rollers and an arbor 3. Close to the opposite end side of an arbor 3, a further neck element-folding stationary means in form of a block-shaped member 15' is provided, with an adjustable block-shaped abutment member 115 being secured thereto, the fore end side edge of a neck element C—by taking into account the neck element conveyance direction, being caused to abut against the said block-shaped abutment member. The neck element-feeding guide 18 and the block-shaped neck element abutment member 115 are so arranged that each neck element C will be set relative to the respective arbor 3, exactly in the position that the neck element must take relative to the rest of a cigarette box, with its end portions C' to be folded over the arbor side edges, projecting from the side edges of the associated arbor 3. The side 215 of the block-shaped stationary neck element-folding member 15' which is turned toward an arbor 3, that is, toward the fore end side edge of the being-supplied neck element C, is advantageously so slanted or bias-cut that the neck element fore end side edge tending to slightly bend downwards, is allowed to slide on the said side 215, so that it is guided to the block-shaped abutment member 115 without any jamming being produced.

At the station S4 for arbors 3 to be fed with paperboard blanks F from which hard cigarette boxes are made by causing these blanks to be folded, a blank-feeding device 23 is provided for feeding the cigarette box blanks to the respective arbors 3. In each blank F the following panels are obtained by means of predetermined blank-folding score lines L, i.e.: the panels F1, F2 for forming the front and the rear side of a cigarette box; the panels F3, F4 for forming the side edges thereof; the flaps F5, F6, and F7 which are connected with the panel F1 for the cigarette box front side, and respectively are for forming the cigarette box bottom end side, and the front side and the top end side of the cigarette box lid; the flaps F8, and F9, F10 which are associated with the panel F2, and respectively are for forming the cigarette box bottom end side, and the rear and top end side of the cigarette box lid; the panels F12, F11 for forming the side edges of the cigarette box lid; the connection flaps F13, F15 and F14, F16 which are respectively associated with the cigarette box bottom end side and with the top end side of the cigarette box lid; and the connection flap 17 which is associated with the side edge F4 of a cigarette box.

Figures 6, 19, 20:
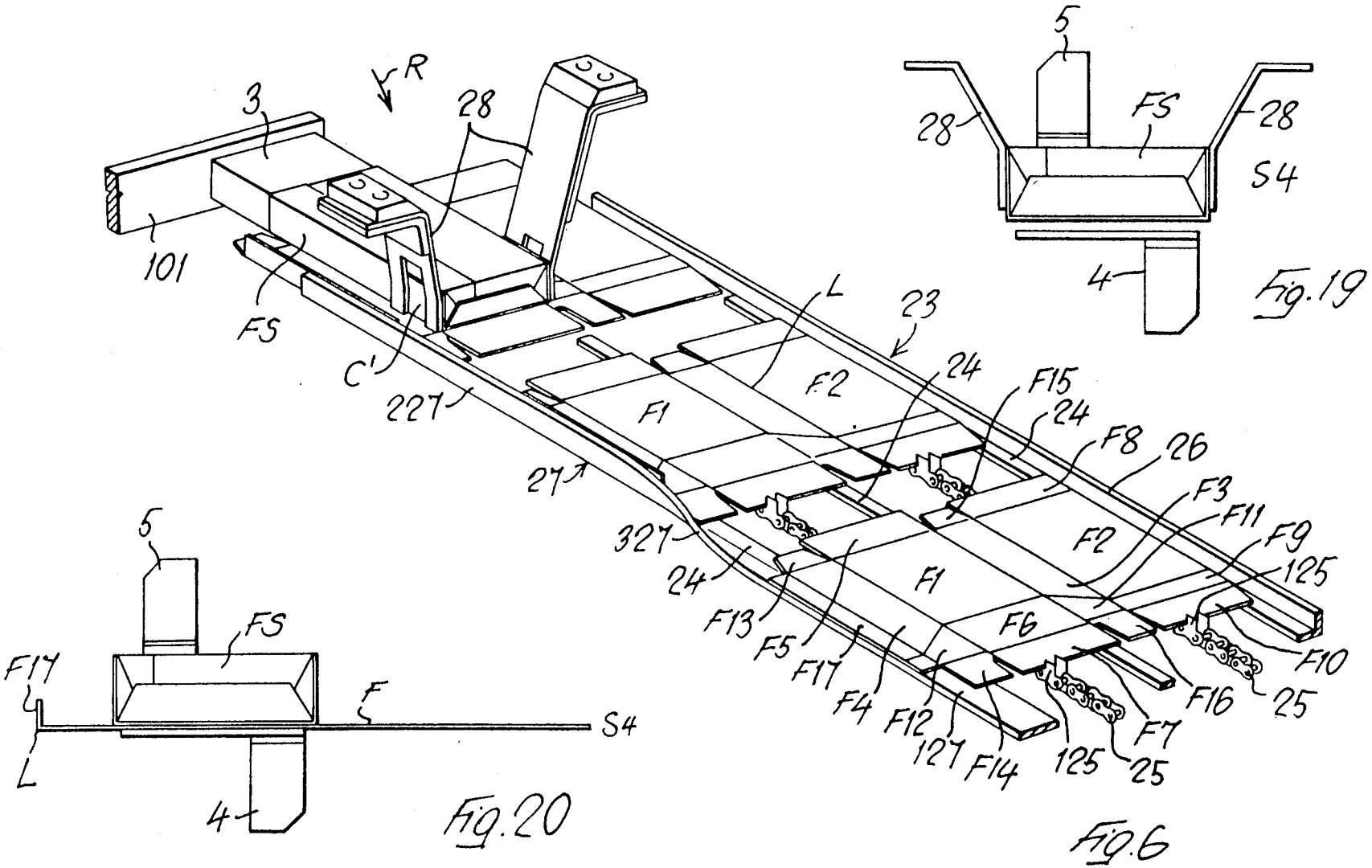
FIG. 6 is a perspective view showing the blank-feeding device.
FIGS. 19 to 23 show the feeding and folding steps of a cigarette box blank.

Referring to FIG. 6, the device 23 for feeding blanks F for hard cigarette boxes, consists of plural blank-guiding parallel guides 24 extending in the direction of the longitudinal axis of the respective arbor 3, and being arranged in such a spaced apart relation that a room is provided between them for two blank-entraining chains 25 to be received therein. The blank-entraining chains 25 are parallel to each other and are operated in the direction of an arbor 3, for example by motor-driven, suitable gear wheels (non shown) for driving and guiding the said chains. The blank-entraining chains 25 are fitted with blank-driving upper teeth 125 cooperating with the rear end side edge of a cigarette box blank, by taking into account the blank-conveyance direction indicated by arrow T2. The slide plane of guides 24 lies before the fore side of an arbor 3—by taking into account the forward direction of the arbor's angular movement, and the device for feeding blanks F has its median axis arranged in a transversally offset position relative to the median longitudinal axis of an arbor 3. The offset arrangement of the blank-feeding device is such that the panel F1 of a blank F, which is for forming the cigarette box front side, is caused to perfectly coincide with the fore side of the respective arbor 3. A vertical guide 26 is provided on that side of the blank-feeding device 23 which is associated with the outward side edge of a blank panel F2 for forming the rear side of a cigarette box. On the opposite side, the blank-feeding device 23 is fitted with a further lateral guide 27 consisting of three sections. The initial section 127—by taking into account the blank conveyance direction T2, is coplanar to the guides 24, and on this initial section there is caused to slide the connection flap F17 which is associated with the blank panel F14 for forming one cigarette box side edge. The said initial section 127 is connected through an intermediate helical section 327 to the end section 227 of guide 27, which is arranged substantially at right angles with the blank conveyance plane of guides 24, in an inwardly shifted position coinciding with the predetermined blank-folding score line L between the said connection flap F17 and the panel F4 of blank F, for forming one side edge of a cigarette box. Thus, as a blank F is being fed to an arbor 3, not only the blank panel F1 for forming the front side of a hard cigarette box is exactly positioned relative to the respective arbor 3, but also the flap F17 for connection of the cigarette box side edge F4 with the panel F2 for forming the cigarette box rear side, is being correctly folded. This allows a blank F to be positioned in such a precise manner relative to the respective arbor 3, that the use of a jogger is unnecessary, since no clearance needs to be provided between the two lateral guides 26 and 27. The precise positioning of a neck element in the longitudinal direction of the respective arbor 3, is achieved by means of suitable stationary abutment members, not shown in detail in the Figure. At station S4 further means 28 are advantageously provided for clampingly holding in the correct position a neck element C, which is fed to this station with its arbor-projecting flaps C' being folded over the respective side edges of an arbor 3. The said means are in form of fixedly supported resilient bars which are spaced apart from each other to a slightly shorter degree than the extent of an arbor 3 in the radial direction of the arbor-carrying drum 1. The said bars 28 are so provided as to be in a substantially convergent relation, and are so arranged that the same are caused to cooperate respectively with the areas of an arbor 3 side edges, over which are folded the projecting flaps C' of neck element C, whereby these flaps C' will be clamped against the respective side edge of the associated arbor 3, during the dwelling time in station S4. The bottom ends of bars 28 are fork-shaped.

In station S4 means (not shown) for a layer of glue to be applied to predetermined areas of blanks F, are associated with the blank-feeding device 23.

At the successive station S5 for a blank F to be folded about the respective arbor 3, stationary folding means 29 are provided, which are in form of rollers arranged at such a distance between them that corresponds to the extent in the radial direction of an arbor 3, and are each caused to cooperate with the respective side edge of the associated arbor 3, pivotable folding means 30 being also provided for folding the respective panels F17 and F2 of blank F over the rear side of this arbor 3.

At the station S6 for the top end side of a cigarette box lid to be closed, the following means are provided: a folding means 31 for folding the panel F10 of blank F which is associated with the rear side of the cigarette box lid, the said folding means 31 being in form of a folding blade whose length corresponds to the length dimension of the lid top end side, and which is movable tangentially to the plane of the free end side of an arbor 3; two oppositely arranged movable folding means 32 for folding the connection flaps F14 and F16 which are associated with the side edges of a cigarette box lid, the said folding means 32 being movable in mutually contrary directions, tangentially to the plane of the free end side of an arbor 3; and a stationary folding means 33 for folding the blank panel F7 which is associated with the front side of a cigarette box, and is for forming the top end side of the cigarette box lid, the said stationary folding means 33 being in form of a roller whose length corresponds to the length dimension of the lid top end side, and being located before an arbor 3, by taking into account the forward direction of the arbor's angular movement.

In the successive stations S7 to S12 a cigarette box having been almost entirely formed about the associated arbor 3 is subjected to further finishing steps, such as a heating step for the setting of the applied glue to be promoted, an impression step for any marking to be impressed by suitable pressure means, and a cigarette-feeding step for an orderly group of cigarettes to be inserted into the respective arbor 3. More particularly, pressure means to be pressed against the inner side of a cigarette box lid, and stamping means fitted with a marking die (both of them not shown), may be provided at the stations S7 and S8 in which the top end side of a cigarette box lid is marked and finished. The pressure and stamping means provided in stations S7 and S8, are caused to cooperate with a block-shaped heated counteracting member bearing against the outward top end side face of the lid of a cigarette box P.

The heated plate 34 extends from station S8 to station S12. The said plate is caused to bear against the outward top end side face of the lid of a cigarette box P. The plate 34 may be heated by a set of heating elements designated as a whole by reference numeral 35, which are fastened to this plate 34. In station S10 an orderly group of cigarettes is transferred by known means and in the known usual mode into the respective arbor 3.

From the foregoing clearly springs out the operation of the cigarette-packing machine according to the present invention.

Figure 9:
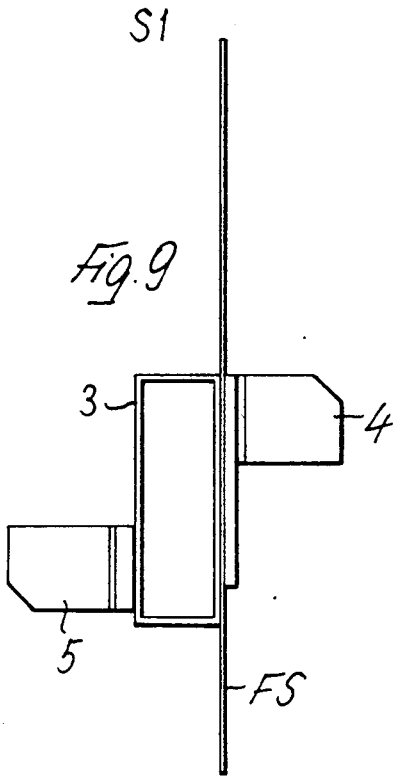
FIGS. 9 to 12 diagrammatically show the sequential steps of feeding a tin foil sheet to, and folding the same about the respective arbor.
Figure 10:
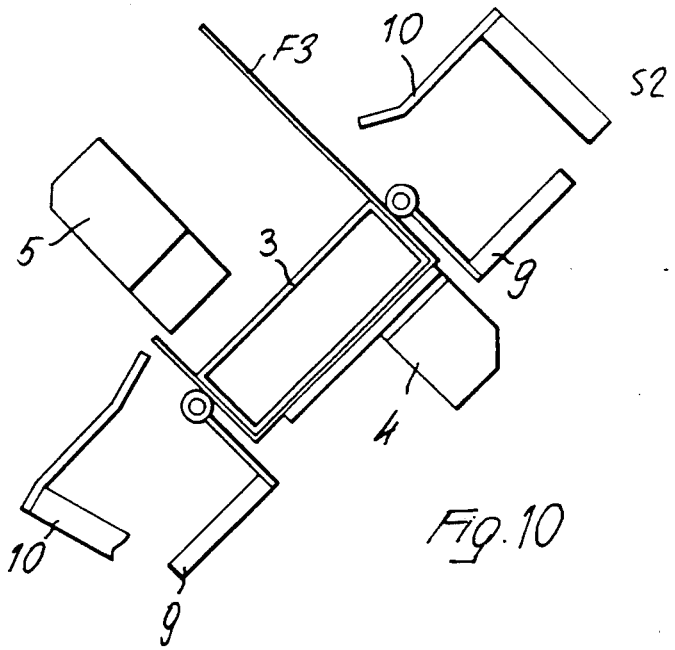
Figure 11:
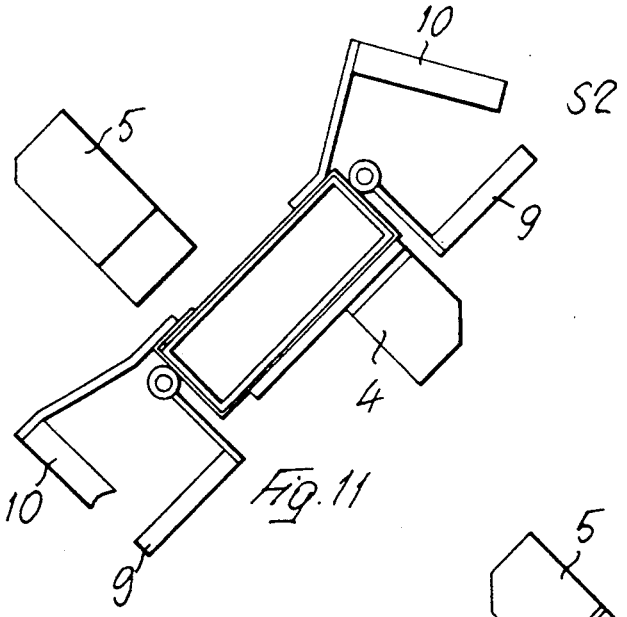
Figure 12:
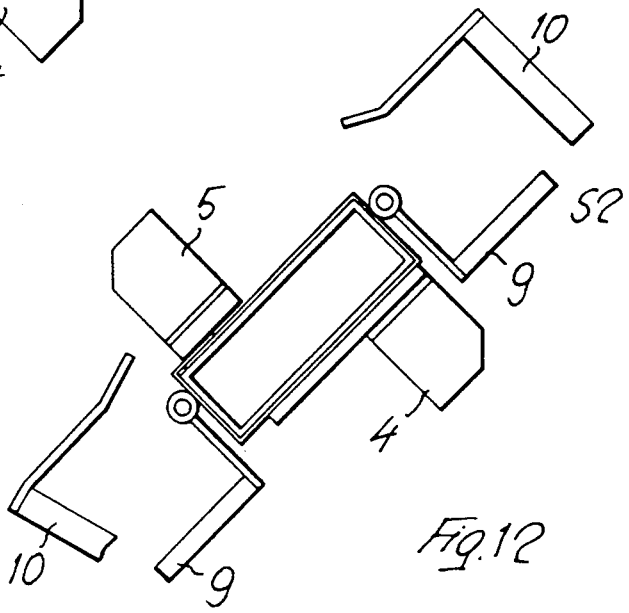
Figure 15:
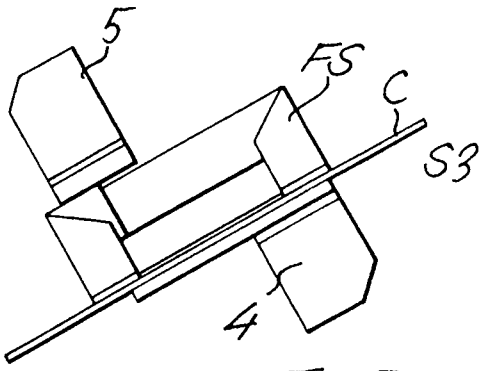
FIGS. 13 to 15 show the feeding steps of a neck element to the respective arbor.
Figure 14:
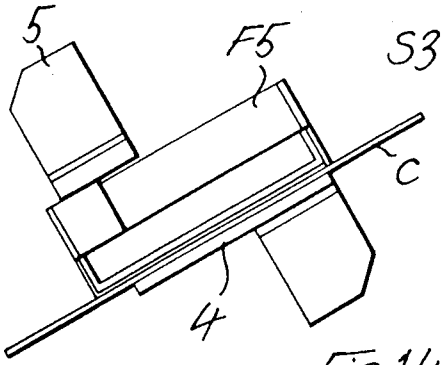
Figure 13:
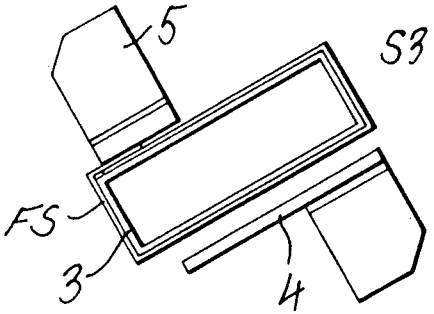

In station S1, after that a cigarette box P formed in the preceding cycle about an arbor, has been ejected from the associated arbor 3 simultaneously with the cigarettes contained therein, to this cleared arbor 3 a tin foil sheet FS is fed onto the fore side thereof—by taking into account the direction of rotation of the arbor-carrying drum 1, and is retained on this arbor 3 by the tin foil sheet-retaining pressure member 4 (FIG. 9). While the arbor-carrying drum 1 is being rotated by one step from station S1 to station S2 (FIG. 10), the fed tin foil sheet FS is being U-folded by the stationary folding means 9 over the side edges of the associated arbor 3. In this same station S2, during the arbor-carrying drum dwelling time, the pivotable folding means 10 are operated, whereby the remaining parts of the fed tin foil sheet FS are folded over the rear side of the associated arbor 3—by taking into account the direction of rotation of the arbor-carrying drum 1, the tin foil sheet FS being thus entirely wound round its arbor 3. The tin foil sheet FS is held in its folded position by the tin foil sheet edge-holding pressure member 5 which is caused to act upon the area on which the end portions of the tin foil sheet FS are superposed (FIG. 12).

By the arbor-carrying drum 1 being further rotated by one step, arbor 3 is angularly moved to the station S3 in which a neck element C is transversally fed to this arbor 3, between the tin foil sheet-retaining pressure member 4 drawn away therefrom, and the fore side of arbor 3 enclosed by the tin foil sheet FS. As disclosed above more in detail, the fed neck element C is correctly positioned relative to the cigarette box to be formed in the successive stations, and is retained in this position by the very same tin foil sheet-retaining pressure member 4. Nextly, as shown in FIGS. 14, 15, 16, 17, the pivotable folding means 11 and the hammer-like folding means 12 are operated, whereby the flaps of the tin foil sheet FS, projecting from the arbor 3 free end side, are folded thereover. The remaining projecting flap of tin foil sheet FS and the side end portions C' of neck element C are folded by the stationary folding means 15 and 13 respectively over the free end side and over the side edges of the associated arbor 3, as the arbor-carrying drum 1 is being further rotated by one step from station S3 to station S4 (FIG. 18).

In station S4 a blank F is fed between the arbor 3 fore side—by taking into account the direction of rotation of the arbor-carrying drum 1, and the tin foil sheet-retaining pressure member 4 drawn away from this arbor 3, and the said blank is retained in its correct position relative to the arbor 3 by the very same tin foil sheet-retaining pressure member 4. At the same time, the neck element C is held in its folded position by the oppositely arranged resilient bars 28. While a blank F is being conveyed to arbor 3, the connection flap F17 to be superposed in a successive station to the rear side of arbor 3, is folded perpendicularly to the end sides thereof (see FIGS. 19, and 20).

Figure 21:
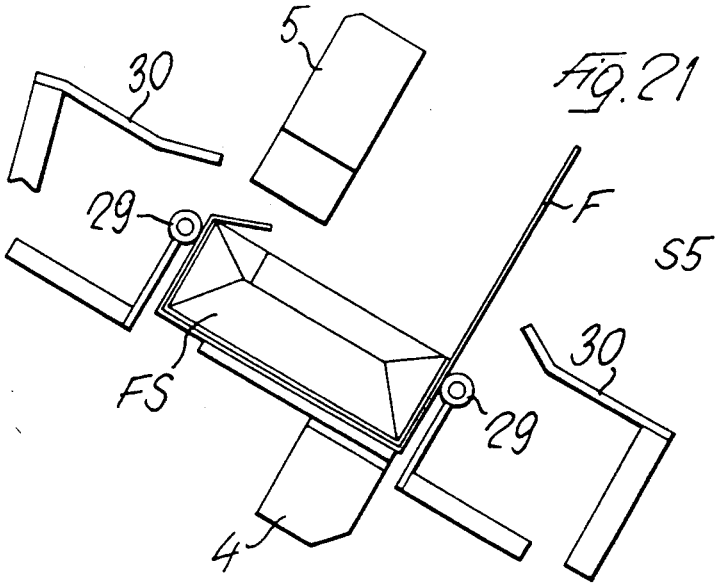
Figure 22:
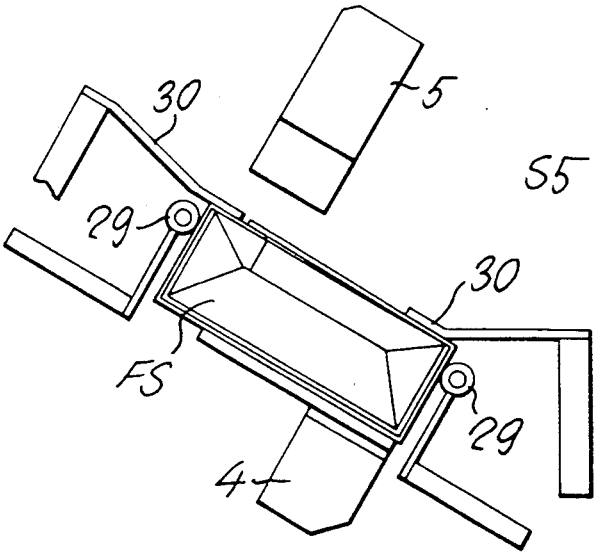
Figure 23:
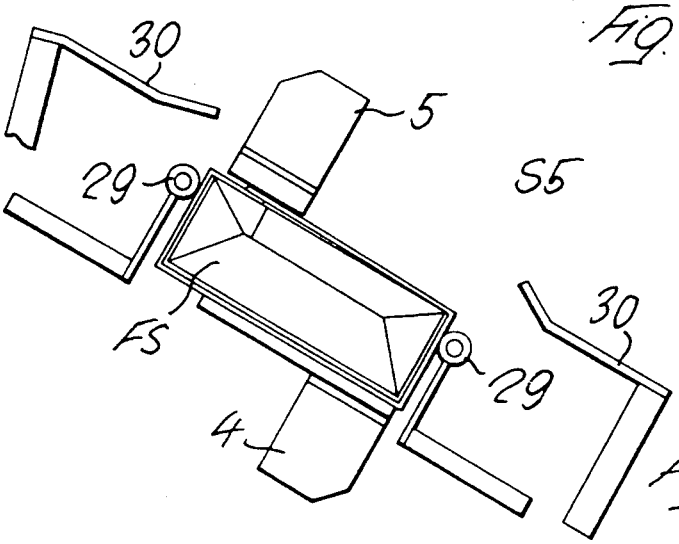
Figure 25:
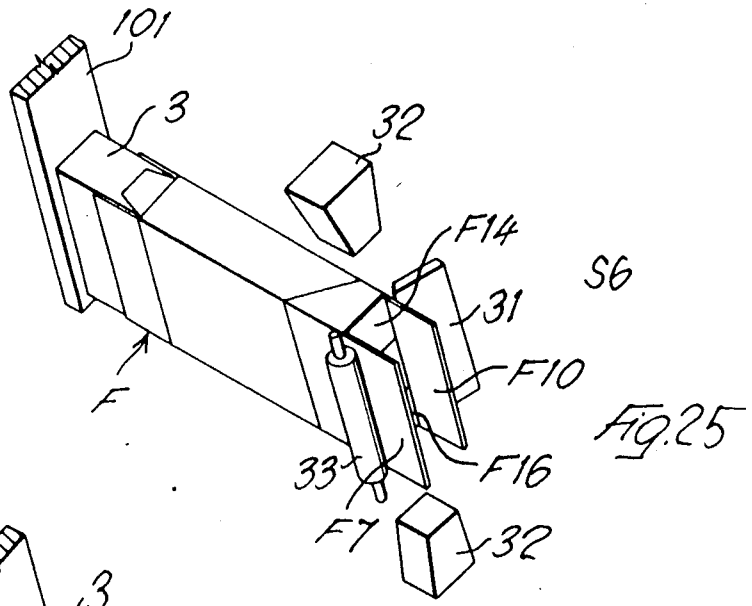
FIGS. 24 to 27 show the folding steps of a cigarette box blank over the bottom end side of a cigarette box.
Figure 27:
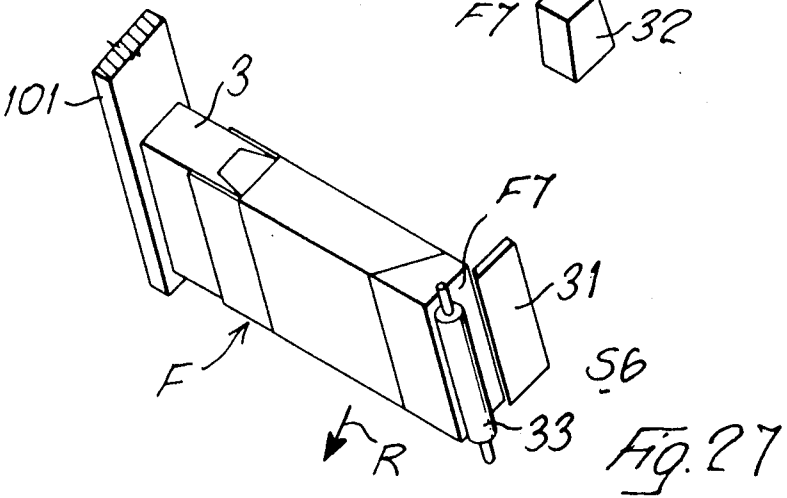
Figure 24:
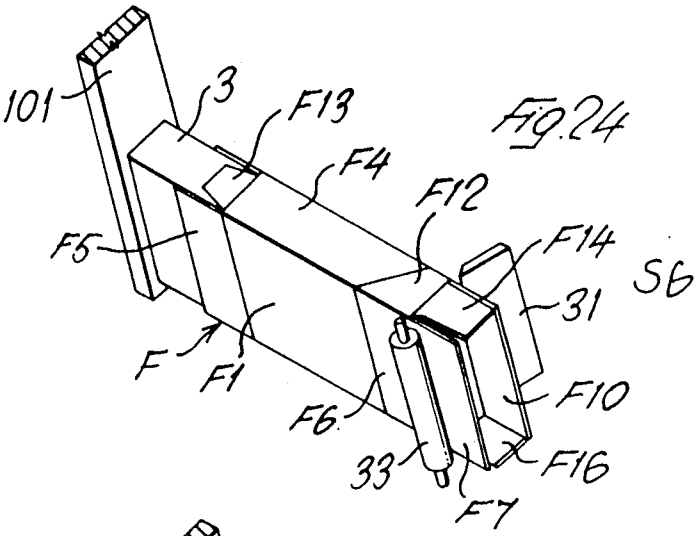
Figure 26:
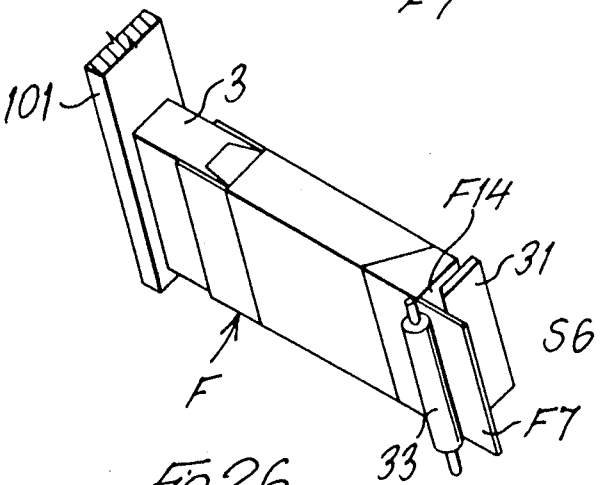

While the arbor-carrying drum 1 is being subsequently rotated by one step toward and to station S5, the stationary folding means 29 and the pivotable folding means 30 are set in operation, whereby the blank F is wound round the arbor 3, in a similar manner as disclosed for the tin foil sheet FS (see FIGS. 21, 22, 23). For this purpose, the edge-holding pressure member 5 is at first drawn away from, and then drawn against this arbor 3.

Referring to FIGS. 24 to 27, there is shown that in station S6 the cigarette box P is closed at its top end side, that is, at its lid end side. This is accomplished by the movable folding means 32 by which the connection flaps F14 and F16 associated with the cigarette box side edges, are folded over the arbor 3 free end side, and by the folding blade 31 by which the panel 10 of blank F, associated with the cigarette box P rear side, is folded over the connection flaps F14 and F16. The opposite flap F7 is folded by the stationary folding means 33 over the arbor 3 free end side and is superposed to the said already folded parts, as the arbor 3 is being angularly moved from station S6 to station S7.

In station S7 the cigarette box P is entirely formed, but for its bottom end side. Set in operation in station S7 and in station S8 are the pressure means to be pressed against the inner side of the cigarette box lid, and the stamping means for any marking to be impressed on the cigarette box lid end side, as well as heating block means (not shown) for heating the cigarette box lid. This allows the setting of the glue to be quickened, and any marking to be impressed on the tin foil sheet FS, or on the cigarette box lid.

The setting of the glue will be complete while the cigarette box is being caused to travel along the heating plate 34 from station S9 to station S12. In station S10 an orderly group of cigarettes is transferred from drum 7 into the respective arbor 3. This is effected in a substantially known manner.

By the last step of the arbor-carrying drum rotation from station S12 to station S1, an arbor 3 has been angularly moved over a complete turn, and a cigarette box-forming cycle is terminated. Therefore, the formed cigarette box P is slipped out of the associated arbor 3, while being at the same time filled with an orderly group of cigarettes, by the cigarette box-ejecting pusher member 37, and is positioned at the inlet of the channel 39 for removal of the finished cigarette boxes. As disclosed more in detail by referring to FIGS. 7 and 8, the pivotable folding means 41 and the folding blade 42 are operated for the connection flaps F13 and F15 associated with the cigarette box side edges, for the flap F8 associated with the cigarette box rear side, and for the underlying flaps of the tin foil sheet FS, to be respectively folded, in order to close the bottom end side of the formed cigarette box P. The opposite flap F5 which is associated with the front side of a cigarette box P, is finally folded over the cigarette box bottom end side by the end side edge 43 of the adjacent vertical wall of the cigarette box-removal channel 39, as the cigarette box P is being inserted into the said channel 39 by the pusher member 40. Immediately after that a cigarette box P has been ejected simultaneously with an orderly group of cigarettes from its arbor 3, a fresh tin foil sheet FS is fed to this cleared arbor 3 for a further cigarette box-forming cycle to be carried out.

The cigarette-packing machine according to the invention, may be also operated for processing cigarette box blanks F lined with tin foil on their inner side, the tin foil sheet feeding and folding steps being thus avoided. In this case, the cigarette-packing machine is substantially the same from the standpoint of construction.

The advantages of the present invention mainly reside in the feature that a correct positioning is afforded of a neck element C relative to the position that the neck element must take in a cigarette box. Such a correct positioning is achieved by separately feeding neck elements and cigarette box blanks. The means used are relatively simple, and these means may be fit without any expensive adaptation, for forming devices being easily and accurately applicable even to existing cigarette-packing machines, of the type for making soft cigarette packs.

I claim:

1. A cigarette-packing machine for packing cigarettes into hard boxes, the hard boxes having an integral hinged lid and being formed by causing a suitable cigarette box blank to be folded about a separate neck element so that the hard box is open at both end sides thereof and is fit for receiving thereinto an orderly group of cigarettes, the machine comprising:

a rotatable arbor-carrying drum including a plurality of arbors projectingly fitted thereon in an angularly equispaced relation, said arbors having a longitudinal axis and being angularly moved stepwise by the rotated arbor-carrying drum one after another into successive stations to form a cigarette box;

movable folding means and stationary folding means being provided for cooperation in certain stations with a respective said arbor for folding the neck elements and box blanks about said arbors;

a first feeding means provided at a certain cigarette box-forming station for feeding neck elements to the respective said arbor, said feeding means feeding the neck element to the respective said arbor transversally to the longitudinal axis of said arbor; and a second feeding means provided at a next-following certain station to the cigarette box-forming station for feeding cigarette box blanks to the respective said arbor in parallel relation with the longitudinal axis of said arbor.

2. The cigarette-packing machine according to claim 1, characterized in that the first feeding means for feeding neck elements places the neck element in contact with a fore side of the respective said arbor relative to a forward direction of rotation of said drum exactly in a position on said arbor to receive the cigarette box blank as for a finished cigarette box.

3. The cigarette-packing machine according to claim 1, further including a means for holding the neck element in position on the respective said arbor; wherein said arbors have side edges which are arranged transversally to a radial direction of the arbor-carrying drum; wherein said stationary folding means folds the neck element over the side edges of said arbors; and further including a clamping means for clampingly holding the neck element in the folded position against the associated said arbor while the box blank for the cigarette box is being fed to a successive blank-feeding station.

4. The cigarette-packing machine according to claim 1, and further including a positioning means for ensuring that the box blank is exactly positioned relative to the respective said arbor, said positioning means including blank-positioning abutment members.

5. The cigarette-packing machine according to claim 1, characterized in that a tin foil sheet-retaining pressure member is placed before a fore side of a respective said arbor, the neck element and the box blank being fed between the tin foil sheet-retaining pressure member and the fore side of the respective said arbor.

6. The cigarette-packing machine according to claim 1, characterized in that the second feeding means for feeding cigarette box blanks is transversally offset relative to the longitudinal axis of an associated said arbor to such an extent that a panel the box blank which forms a front side of the cigarette box is substantially coaxial to a fore side of said arbor and is caused to perfectly coincide therewith at an end-of-conveyance position.

7. The cigarette-packing machine according to claim 1, characterized in that the stationary folding means includes members which are caused to cooperate with said arbor for the neck element and the box blank to be folded while the arbor-carrying drum is being rotated by one step, and the movable folding means is one of oscillating bars, pivotable hammer-like members, or reciprocating folding blades.

8. The cigarette-packing machine according to claim 1, characterized in that the first feeding means for feeding neck elements consists of a conveyor element and a channel-shaped guide for the neck elements to slide thereon.

9. The cigarette-packing machine according to claim 8, characterized in that the conveyor element consists of a continuous belt conveyor, motor-driven guide rollers over which said belt conveyor is lead, and neck element-entraining teeth on said belt conveyor which are set apart from one another by a distance that corresponds to a length dimension of the neck elements.

10. The cigarette-packing machine according to claim 9, characterized in that in a bottom of the channel-shaped guide for the neck elements to slide thereon, a channel is intermediately formed for the conveyor belt to be accommodated and guided therein, said channel-shaped guide being provided at a top side thereof with a retaining means in an overlying relation therewith which is fitted with projecting members for retaining the neck elements in position, said retaining means consisting of a plate and said projecting members being longitudinally arranged rod members secured to the plate with a face turned toward the neck elements.

11. The cigarette-packing machine according to claim 10, characterized in that two counter-rotating speed-up rollers are provided downstream of a delivery end of the channel-shaped guide wich are driven conformably to the belt conveyor, and a plane at which these rollers are tangent is substantially coplanar to a neck element side plane of said channel-shaped guide and with both of the planes lie slightly before an arbor fore-side plane.

12. The cigarette-packing machine according to claim 11, characterized in that said stationary folding means includes (a) a stationary neck element-folding means including block-shaped members provided close to each end side of an assocated said arbor in a substantially tangential relation with a respective said end side thereof, and (b) an adjustable block-shaped abutment member being fitted on a radially inward one of said block-shaped members which is away from the counter-rotating speed-up rollers and which is caused to cooperate with a fore end side edge of the neck elements whereby the neck element is exactly positioned relative to the respective said arbor.

13. The cigarette-packing machine according to claim 12, characterized in that a side of one of the block-shaped member which is turned toward the fore end side edge of the neck element affords a slide surface for the fore end side edge of the neck elements, said side of said one of said block-shaped members being inclined in a direction of the adjustable block-shaped abutment member.

14. The cigarette-packing machine according to claim 11, characterized in that the counter-rotating speed-up rollers and the motor-driven guide rollers for the belt conveyor are dynamically connected with each other and to a driving member by one of a chain or a belt.

15. The cigarette-packing machine according to claim 1, characterized in that the second feeding means for feeding cigarette box blanks consists of mutually spaced apart plural parallel guides between which are received blank-entraining members and which said members are caused to run parallel to said guides, said members being fitted with blank-driving teeth which are equally spaced apart from each other according to a size of the box blanks and which are caused to cooperate with a rear end side edge of the box blank.

16. The cigarette-packing machine according to claim 15, characterized in that the second feeding means for feeding cigarette box blanks is further provided with first and second lateral guides arranged in perpendicular relation with the parallel guides, said first lateral guide being perpendicular to said parallel guides throughout a length thereof, and said second lateral guide including a third folding means for folding a connection flap of the box blank in an arrangement at right angles with a rest of the box blank such that the connection flap is subsequently folded over a rear side of the associated said arbor.

17. The cigarette-packing machine according to claim 16, characterized in that the second lateral guide wich includes the third folding means has an initial section arranged coplanarly to the parallel guides on which there is caused to slide a box blank side edge portion that forms the connection flap and an end section which is arranged perpendicularly to a blank slide plane of the parallel guides and which is shifted inwardly by a same amount as a width dimension of the connection flap, said two sections being interconnected by an intermediate helical section; and in that the box blank is provided with a predetermined blank-folding score line at least between said connection flap and the rest of the box blank.

18. The cigarette-packing machine according to claim 1, characterized in that a plane on which the cigarette box blanks are caused to slide extends between a tin foil sheet-retaining pressure member and a fore side of the respective said arbor; and in that two downwardly converging, stationary resilient bars are provided between which said arbors are inserted, said resilient bars beings each caused to cooperate with a respective side edge of said arbors for clampingly holding in position end portions of the neck element which have been previously folded over the side edges of said arbor.

19. The cigarette-packing machine according to claim 1, characterized in that at a final cigarette box-forming station in which the cigarette box is entirely formed about the associated said arbor and an orderly group of cigarettes has been inserted thereinto, there is provided: an ejecting means for ejecting from the respective said arbor the orderly group of cigarettes simultaneously with the formed cigarette box; a cigarette box removal channel having a removal channel inlet; and a second movable folding means and a second stationary folding means at the removal channel inlet for closing a bottom end side of the cigarette box.

20. The cigarette-packing machine according to claim 19, characterized in that: the ejecting means consists of first and second oppositely arranged pusher members, the first pusher member being caused to act on the orderly group of cigarettes contained in the respective said arbor, and the second pusher member being caused to act on a top end side of the lid of the cigarette box and to cooperate with the first pusher member for limiting a cigarette box ejection stroke at the removal channel inlet of the cigarette box removal channel; the cigarette box removal channel is arranged transversally to the longitudinal axis of the respective said arbor and to a longitudinal axis of the cigarette box; and a third pusher member is provided for insertion of cigarette boxes into the cigarette box removal channel and is caused to act on a cigarette box side lying opposite to the cigarette box removal channel.

21. The cigarette-packing machine according to claim 20, characterized in that close to the bottom end side of the cigarette box there are provided: a folding blade wich is reciprocatingly movable tangentially to a plane of the cigarette box bottom end side, in both senses of a direction in wich cigarette boxes are inserted into the cigarette box removal channel; the stationary folding means which is contiguous to a bottom end side edge of the cigarette box and formed by respective opposite end side edges of respective vertical walls of the cigarette box removal channel; and said second stationary foldings means including a first pivotable folding means for folding projecting flaps associate with a front and a rear side of the cigarette box and a second pivotable folding means for folding connection flaps associated with side edges of the cigarette box over the bottom end side thereof.

22. The cigarette-packing machine according to claim 21. characterized in that the second pivotable folding means consists of pivotable hammer-like members.

23. The cigarette-packing machine according to claim 21, characterized in that the second pivotable folding means includes associated pairs of folding heads and retaining heads for folding and retaining in folded position the respective connection flap, with each respective associated said folding head and retaining head arranged in a side-by-side relation at the respective end side edge of the bottom end side of the cigarette box and with the folding head being interposed between the associated retaining head and a folding blade, said folding heads being thicker than the retaining heads, and both heads being at the same time angularly movable from a rest position into a flap-folding and folded flap-retaining position against the cigarette box bottom end side, the folding heads being immediately returnable into the rest positions concomitantly with the folding blade being set in operation while the retaining heads are kept in the folded flap-retaining positions until the folding blade has been moved over a predetermined length of a stroke thereof toward said retaining heads.

24. The cigarette-packing machine according to claim 23, characterized in that the folding heads have a wedge-shaped configuration, with a side thereof turned toward the folding blade having an inclination that substantially corresponds to an inclination of the flap of the cigarette box at a begining of the folding by the folding blade.

25. The cigarette-packing machine according to claim 1, characterized in that the arbor-carrying drum is fitted with twelve angularly equispaced, radially extending spoke members on which an equal number of said arbors are projectingly mounted with the longitudinal axes thereof directed parallel to a rotational axis of the arbor-carrying drum such that the arbor-carrying drum is stepwise rotated by steps of an angular extent equal to an angular spacing between the spoke members with the stepwise rotation of the arbor-carrying drum being alternated with dwelling times; and a cigarette box-forming station provided at each location at which said arbors dwell.

26. The cigarette-packing machine according to claim 25, characterized in that in the order of succession according to the direction of rotation of the arbor-carrying drum, the following said stations are provided:

(a) a first station provided with (i) an ejecting means for ejecting a formed cigarette box simultaneously with an orderly group of cigarettes, (ii) a closing means for closing a bottom end side of the cigarette box, (iii) a removal means for removing the cigarette box, (iv) a feeding means for feeding a tin foil sheet, (b) a second station provided with a first discrete stationary folding means of said stationary folding means and a first discrete pivotable folding means of said movable folding means for folding the foil sheet about the respective said arbor, (c) a third station provided with (i) said feeding means for feeding neck element, (ii) a second discrete pivotable folding means of said movable folding means and a second discrete stationary folding means of said stationary folding means for folding the tin foil sheet over a free end side of the respective said arbor, and (iii) a third discrete stationary folding means of said stationary folding means for folding projecting flaps of the neck element, (d) a fourth station provided with (i) said feeding means for feeding a cigarette box blank, (ii) a means for applying a layer of glue on said box blank, (iii) a flap folding means for folding a connection flap of the box blank, and (iv) a clamping means for clampingly holding the projecting flaps of the neck element in the folded position, (e) a fifth station provided with a fourth discrete stationary folding means of said stationary folding means and a third discrete pivotable folding means of said movable folding means for widing the cigarette box blank around the associated said arbor, (f) a sixth station provided with a fourth discrete pivotable folding means of said movable folding means and a fifth discrete stationary folding means of said stationary folding means for respectively folding flaps and second connection flaps of the cigarette box blank over a free end side of the associated said arbor, (g) a seventh and an eighth station provided with a means for impressing a marking on a top end side of one of the cigarette box or the tin foil sheet, and for heating the cigarette box top end side to promote setting of an applied glue, and (h) further successive stations with common heating means extending therealong for heating the associated said arbors so as to promote the setting of the glue, one of said successive stations being provided with a cigarette feeding means for feeding an orderly group of cigarettes into an associated said arbor.

27. The cigarette-packing machine according to claim 1, characterized in that this cigarette-packing machine can be used for making hard cigarette boxes from box blanks being suitably folded about the respective said arbor and being lined on an inner side thereof with a tin foil, and further incluiding a disabling means for disabling the feeding and folding means for associated said stations so that said feeding and folding means are left in an inoperative condition.

28. The cigarette-packing machine according to claim 26, characterized in that the feeding means, the folding means, the removal means and the closing means are in the form of accessory devices wich are subsequently fitted to an existing cigarette-packing machine for packing cigarettes into soft packs.

* * * * *